US007044832B2

(12) United States Patent
Yilmaz et al.

(10) Patent No.: US 7,044,832 B2
(45) Date of Patent: May 16, 2006

(54) LOAD CUP FOR CHEMICAL MECHANICAL POLISHING

(75) Inventors: Alpay Yilmaz, San Jose, CA (US); Simon Yavelberg, Cupertino, CA (US); Toshikazu Tomita, Narita (JP); Hui Chen, Burlingame, CA (US); Noel Manto, American Canyon, CA (US); David J. Lischka, San Jose, CA (US); Hung Chih Chen, Santa Clara, CA (US)

(73) Assignee: Applied Materials, Santa Clara, CA (US)

( * ) Notice: Subject to any disclaimer, the term of this patent is extended or adjusted under 35 U.S.C. 154(b) by 0 days.

(21) Appl. No.: 10/988,647

(22) Filed: Nov. 15, 2004

(65) Prior Publication Data

US 2005/0176349 A1 Aug. 11, 2005

Related U.S. Application Data

(60) Provisional application No. 60/520,611, filed on Nov. 17, 2003.

(51) Int. Cl.
*B24B 49/00* (2006.01)

(52) U.S. Cl. ..... 451/5; 451/288

(58) Field of Classification Search ..... 451/5, 451/8, 41, 288, 287, 289, 388, 398, 65
See application file for complete search history.

(56) References Cited

U.S. PATENT DOCUMENTS

| | | | | |
|---|---|---|---|---|
| 4,466,852 | A * | 8/1984 | Beltz et al. | 156/344 |
| 4,519,846 | A * | 5/1985 | Aigo | 134/15 |
| 5,329,732 | A | 7/1994 | Karlsrud et al. | |
| 5,738,574 | A | 4/1998 | Tolles et al. | |
| 5,762,543 | A | 6/1998 | Kasprzyk et al. | |
| 5,934,984 | A | 8/1999 | Togawa et al. | |
| 5,947,802 | A | 9/1999 | Zhang et al. | |
| 6,050,884 | A * | 4/2000 | Togawa et al. | 451/67 |
| 6,074,275 | A | 6/2000 | Yashiki et al. | |
| 6,102,777 | A | 8/2000 | Duescher et al. | |
| 6,131,589 | A | 10/2000 | Vogtmann et al. | |
| 6,196,896 | B1 | 3/2001 | Sommer | |
| 6,402,598 | B1 * | 6/2002 | Ahn et al. | 451/65 |
| 6,537,143 | B1 * | 3/2003 | Yang et al. | 451/388 |
| 6,629,883 | B1 * | 10/2003 | Katsuoka et al. | 451/332 |
| 6,716,086 | B1 | 4/2004 | Tobin | |
| 2003/0003848 | A1 | 1/2003 | Tobin | |
| 2004/0127142 | A1 | 7/2004 | Olgado | |

FOREIGN PATENT DOCUMENTS

| | | |
|---|---|---|
| EP | 0347718 | 12/1989 |
| SU | 1323350 | 7/1987 |
| WO | WO 99/41022 | 8/1999 |

* cited by examiner

*Primary Examiner*—Robert A. Rose
(74) *Attorney, Agent, or Firm*—Patterson and Sheridan

(57) ABSTRACT

Embodiments of a load cup for transferring a substrate are provided. The load cup includes a pedestal assembly having a substrate support and a de-chucking nozzle. The de-chucking nozzle is positioned to flow a fluid between the polishing head and the back side of a substrate during transfer of the substrate from the polishing head to the substrate support.

26 Claims, 8 Drawing Sheets

LOAD CUP FOR CHEMICAL MECHANICAL POLISHING

CROSS-REFERENCE TO RELATED APPLICATIONS

This application claims the benefit of now abandoned U.S. Provisional Patent Application Ser. No. 60/520,611, filed on Nov. 17, 2003, which is incorporated by reference herein.

BACKGROUND OF THE INVENTION

1. Field of the Invention

Embodiments in the invention generally relate to a substrate transfer mechanism (e.g., a load cup) for transferring a substrate to and from a polishing head in a chemical mechanical polishing system.

2. Background of the Related Art

Chemical mechanical polishing (CMP) is one of many processes used in the fabrication of high density integrated circuits. Chemical mechanical polishing is generally performed by moving a substrate against a polishing material in the presence of a polishing fluid. In many polishing applications, the polishing fluid contains an abrasive slurry to assist in the planarization of the feature side of the substrate that is pressed against the polishing material during processing. In other chemical mechanical polishing systems, such as electrochemical mechanical polishing systems, the polishing fluid may comprise an electrolyte that provides a current path for the dissolution of a conductive material from the substrate during processing.

The substrate is generally retained during polishing operations by a polishing head. Conventional polishing heads include a retaining ring bounding a substrate retaining pocket. The substrate may be held in the substrate retaining pocket by vacuum, electrostatic force, adhesives, or by other means. The retaining ring prevents the substrate from slipping out from under the polishing head during polishing.

Most CMP systems employ a vertically actuatable transfer mechanism, commonly known as a load cup, to transfer substrates between the polishing head and the blade of the robot. Transfer of a polished substrate from the polishing head to the load cup, also known as de-chucking, is of critical importance as the feature side of the substrate is placed into the receiving mechanism of the load cup. Any misalignment between the substrate and the load cup may result in substrate damage. Moreover, if the substrate is not successfully de-chucked, but is retained in the polishing head, the de-chucking process must be repeated before additional substrates can be processed, which substantially disrupts process throughput. Although most conventional load cups provide reliable substrate transfer, the substantial investment of the fabricator in each substrate along with the need to maintain high throughput levels underscores the need for improved reliability and defect free substrate transfer between the load cup and a polishing head.

Therefore, there is a need for an improved load cup and method for defect-free substrate transfer.

SUMMARY OF THE INVENTION

In one aspect of the invention, a load cup for transferring a substrate is provided. In one embodiment, the load cup includes a pedestal assembly having a substrate support and a de-chucking nozzle. The de-chucking nozzle is positioned to flow a fluid between the polishing head and the back side of a substrate during transfer of the substrate from the polishing head to the substrate support.

In another aspect of the invention, a method for transferring substrates to and from a polishing head is provided. In one embodiment, the method includes engaging a polishing head having a substrate disposed face down therein with a load cup. Next, activating the load cup to engage the back side of the substrate. Then transferring the substrate face down into the load cup.

BRIEF DESCRIPTION OF THE DRAWINGS

A more particular description of the invention, briefly summarized above, may be had by reference to the embodiments thereof illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, wherever possible, to designate identical elements that are common to the figures.

DETAILED DESCRIPTION

Figure 1:
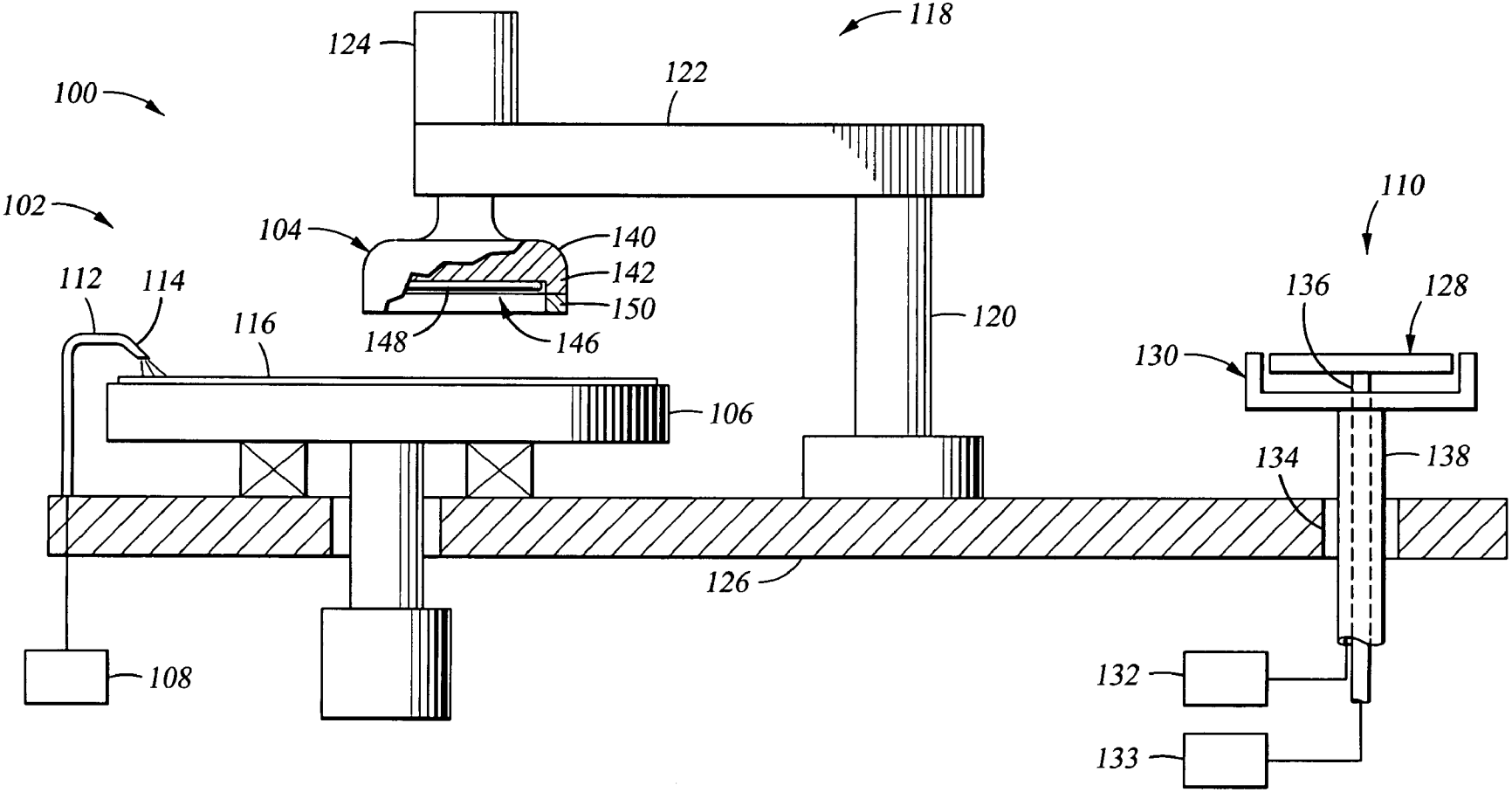
FIG. 1 is a simplified side view, partially in section, of a chemical mechanical polishing system having one embodiment of a load cup of the present invention.

FIG. 1 depicts a partially sectional view of a simplified chemical mechanical polishing system 100 that includes a polishing station 102, a polishing head 104 and one embodiment of a load cup 110 of the present invention. Although the load cup 110 is shown in one embodiment of a polishing system 100, the load cup 110 may be utilized in any polishing system including electrically assisted polishing systems currently being developed for conductive layer polishing, and any other processing system that utilizes a substrate-retaining head to retain a substrate in a face down orientation during processing. Examples of suitable polishing systems which may be adapted to benefit from the invention include MIRRA® and REFLEXION® chemical mechanical polishing systems available from Applied Materials Inc., located in Santa Clara, Calif. Other polishing systems that may be adapted to benefit from the invention include systems described in U.S. Pat. No. 5,738,574, issued Apr. 14, 1998 to Tolles, et al., U.S. Pat. No. 6,244,935, issued Jun. 12, 2001 to Birang, et al., and U.S. patent application Ser. No. 10/880,752, filed Jun. 30, 2004, all of which are hereby incorporated by reference in their entireties.

In one embodiment, the polishing station 102 includes a rotatable platen 106 having a polishing material 116 dis posed thereon. The polishing material 116 may be a fixed abrasive material, a conventional polyurethane polishing pad, other pad suitable for chemical mechanical polishing, or a pad suitable for electrically assisted CMP.

The polishing station 102 additionally includes a fluid source 108 adapted to provide a polishing fluid to the working surface of the polishing material 116 during processing. In the embodiment depicted in FIG. 1, an arm 112 having at least one nozzle 114 is positioned to flow polishing fluid onto the polishing material 116 during processing.

The polishing head 104 is generally supported above the polishing station 102 by a transfer mechanism 118 coupled to a base 126. The transfer mechanism 118 is generally adapted to position the polishing head 104 selectively between a processing position over the polishing material 116 and a transfer position over the load cup 110. In the embodiment depicted in FIG. 1, the transfer mechanism 118 includes a stanchion 120 having a cantilevered arm 122 that may be rotated to laterally position the polishing head 104. The polishing head 104 is coupled to the arm 122 by a drive mechanism 124. The drive mechanism 124 is adapted to control the elevation of the polishing head 104 relative to the base 126, and may optionally be adapted to impart at least a part of the relative polishing motion between a substrate retained in the polishing head 104 and the polishing material 116 disposed on the platen 106. In the embodiment depicted in FIG. 1, the drive mechanism 124 is adapted to rotate the polishing head 104 and substrate during processing. Another transfer mechanism suitable for positioning the substrate relative to the platen 106 and load cup 110 is described in the previously incorporated U.S. Pat. No. 5,738,574, to Tolles, et al.

In one embodiment, the polishing head 104 is a TITAN HEAD™ substrate carrier manufactured by Applied Materials, Inc., located in Santa Clara, Calif. Generally, the polishing head 104 comprises a housing 140 having an extending lip 142 that defines a center recess 146 in which is disposed a bladder 148. The bladder 148 may be comprised of an elastomeric material or thermoplastic elastomer such as ethylene-propylene, silicone, and HYTREL® thermoplastic polyester elastomer. The bladder 148 is coupled to a fluid source (not shown) such that the bladder 148 may be controllably inflated or deflated. When in contact with the substrate, the bladder 148 is deflated, thus creating a vacuum between the substrate and the bladder 148 and thereby retaining the substrate within the polishing head 104. A retaining ring 150 circumscribes the polishing head 104 to further facilitate retaining the substrate within the polishing head 104 while polishing.

The load cup 110 generally includes a pedestal assembly 128 and a cup 130. The pedestal assembly 128 is supported by a shaft 136. The cup 130 is supported by a shaft 138. The shafts 136, 138 extend through a hole 134 in the base 126 and are respectively coupled to actuators 133, 132 that respectively control the elevation of the pedestal assembly 128 and the cup 130 relative to the base 126. The pedestal assembly 128 provides a structure that mates with the polishing head 104 to insure alignment therebetween during substrate transfer. The pedestal assembly 128 is generally extended to transfer the substrate to the polishing head 104 and retracts from the extended position to receive the substrate during the process of de-chucking, as further described below.

Figure 2:
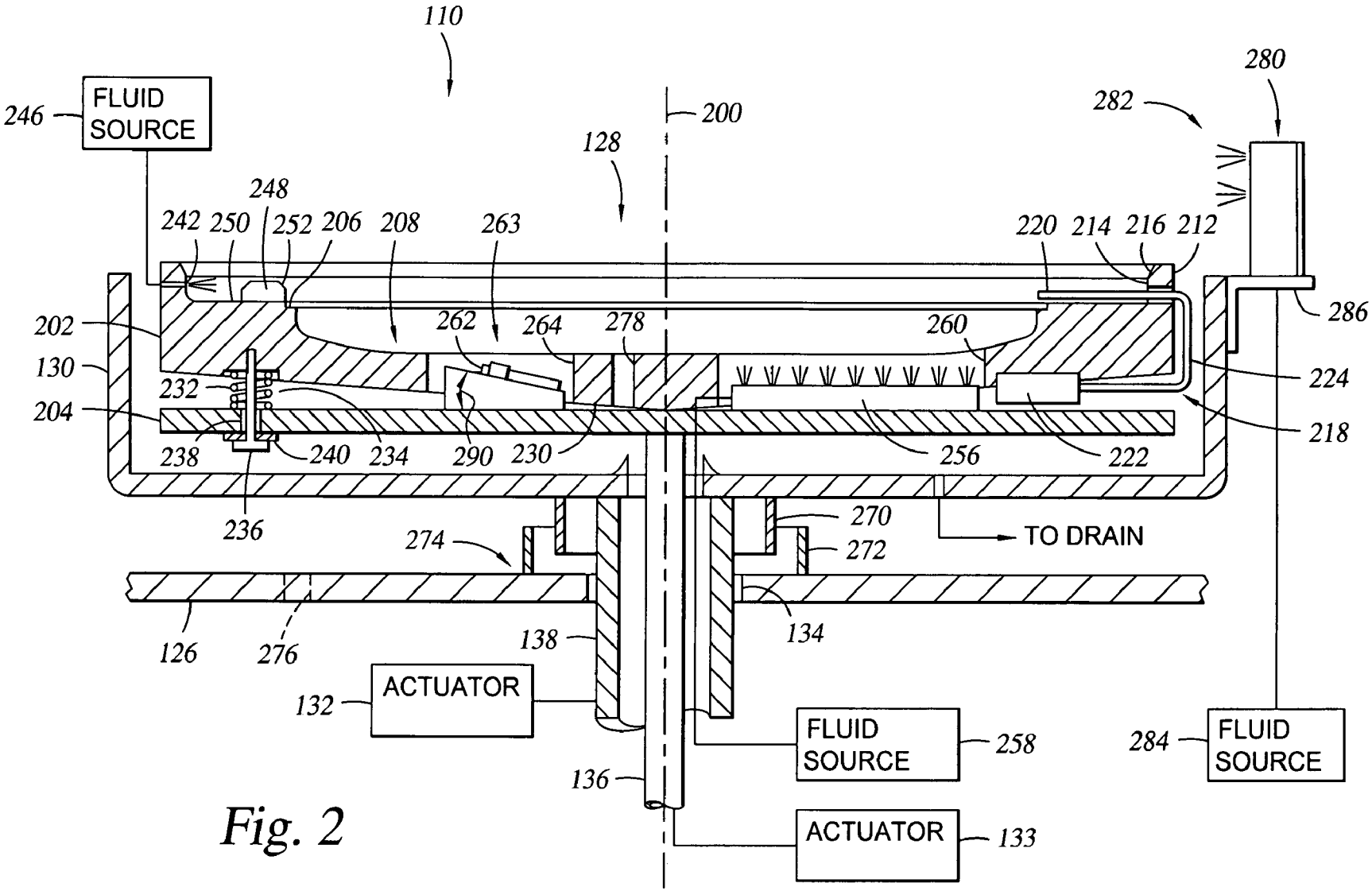
FIG. 2 is a sectional view of one embodiment of a load cup.

FIG. 2 depicts a sectional view of one embodiment of the pedestal assembly 128 and the cup 130 of the load cup 110. The pedestal assembly 128 includes an upper pedestal 202 movably coupled to a lower pedestal 204. The upper pedestal 202 is generally configured to move both angularly and laterally with respect to the lower pedestal 204. In one embodiment, the upper pedestal 202 has a convex bottom surface 230 to facilitate angular and lateral movement with respect to the lower pedestal 204. It is contemplated that other geometries may be used to allow for the angular and lateral movement of the upper pedestal 202 relative to the lower pedestal 204.

In one embodiment, the upper pedestal is biased to remain in parallel with the lower pedestal 204 by a plurality of spring assemblies 234 (one shown for clarity). In one embodiment, each spring assembly 234 includes a bolt 236 extending through a washer 240 and a hole 238 in the lower pedestal 204 and fastened to the upper pedestal 202. A spring 232 is disposed about the bolt 236 and between the upper and lower pedestals 202, 204 to urge the upper and lower pedestals 202, 204 apart. By providing multiple spring assemblies 234 in a spaced apart relation, the upper pedestal 202 may be biased towards a substantially parallel disposition relative to the lower pedestal 204. The hole 238 is of larger diameter than the bolt 236 to allow for lateral movement of the upper pedestal 202 with respect to the lower pedestal 204. In one embodiment, the upper pedestal 202 may have a lateral motion of up to about 3 millimeters from a central axis 200 of the load cup 110. Prior art load cups generally allow lateral motion on the order of 1 millimeter. The increased lateral motion of the upper pedestal 202 accommodates greater tolerance for misalignment between the polishing head 104 and the load cup 110.

In one embodiment of the pedestal assembly 128, a raised lip 212 protrudes axially along the outer edge of the upper pedestal 202. The lip 212 includes an inner wall 214 configured to mate with the polishing head 104 during substrate exchange operations. The inner wall 214 may include a feature 216 suitable to facilitate alignment of the polishing head 104 with the upper pedestal 202 (shown, for example, in FIGS. 2A and 2B). In one embodiment, the feature 216 may be a chamfer, radius, curved surface, and the like.

The upper pedestal 202 is generally configured to support the feature side of the substrate in a face down orientation. In one embodiment, the upper pedestal 202 is substantially circular in shape and is configured with a ledge 206 surrounding a recessed area 208 to contact the substrate only in an exclusion zone of the substrate. The exclusion zone of the substrate is an outer perimeter of the feature side of the substrate that has no features formed on it. Although the physical width of the exclusion zone may vary between fabricators, in the embodiment depicted in FIG. 2, the ledge 206 is about 1.5 millimeters wide to accommodate a 200 millimeter wafer having a 2 millimeter exclusion zone at its perimeter.

Figure 2A:
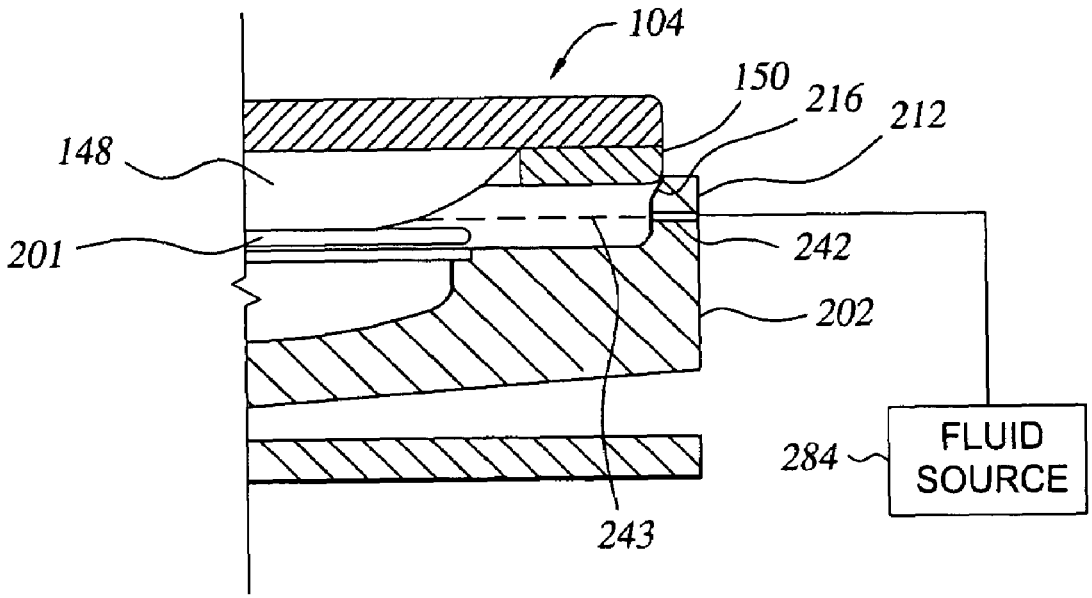
FIGS. 2A and 2B are details of the load cup of FIG. 2.
Figure 2B:
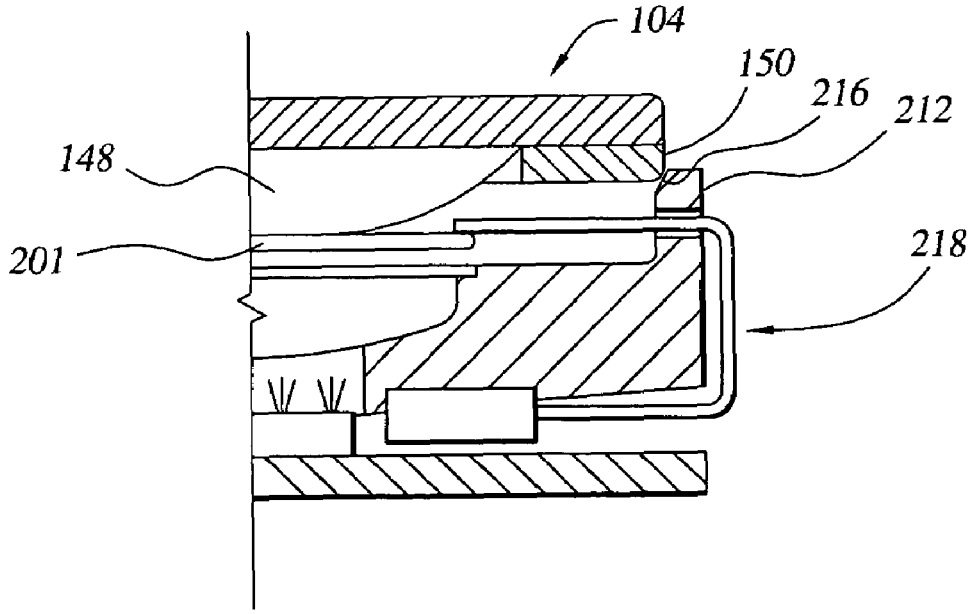

Referring simultaneously to FIGS. 2 and 2B, the pedestal assembly may also include one or more gripper assemblies 218 adapted to mechanically retain the substrate within the load cup 110 by engaging the back side of the substrate. The gripper assemblies 218 may be configured to actuate to a position that maintains a gap between the gripper assemblies 218 and the substrate, such that the gripper assemblies 218 do not contact the substrate during typical substrate transfers, yet retains the substrate by its back side in the event that the substrate inadvertently sticks to the polishing head 104 and moves away from the load cup 110 during unloading of the polishing head 104. For example, FIG. 2B depicts a gripper assembly 218 in contact with a substrate 201 that is being unloaded from the polishing head 104. Alternatively, the gripper assemblies 218 may be configured to contact the backside of the substrate to physically retain the substrate within the load cup 110 as part of every de-chucking operation.

Figure 3:
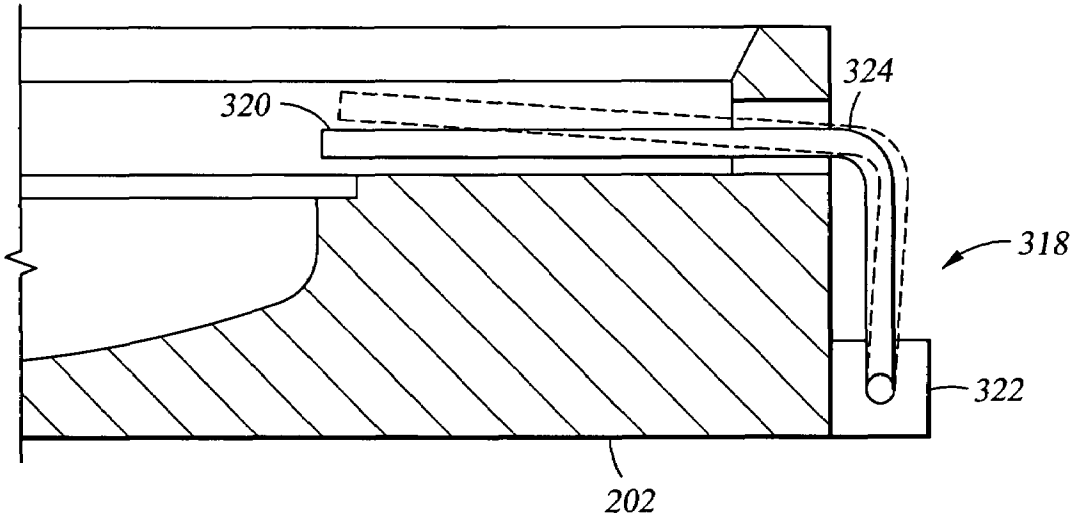
FIG. 3 is a sectional view of one embodiment of a gripper assembly.

In one embodiment, the one or more gripper assemblies 218 may be housed at least partially in the lip 212 of the upper pedestal 202. The gripper assembly 218 generally includes a gripper 220 coupled to an actuator 222 by a bracket 224. The gripper actuator 222 may be disposed below the upper pedestal 202 and is typically mounted to the bottom of the upper pedestal 202 such that the gripper assembly 218 moves in concert with the upper pedestal 202. In the embodiment depicted in FIG. 2, the actuator 222 moves the gripper 220 radially inwards and outwards relative to the central axis 200 of the upper pedestal 202. The gripper actuator 222 may be a solenoid, a hydraulic cylinder, a pneumatic cylinder or other linear actuator suitable for providing the described gripper motion. It is also contemplated that the motion of the gripper 220 may not be linear, and may instead be moved between a position towards and away from the center of the load cup 110 using at least partial rotary motion, or a combination of linear and rotary motion. For example, as depicted in FIG. 3, the gripper assembly 318 comprises a rotary actuator 322 coupled to the gripper 320 by a bracket 324. The angular motion of the gripper 320 provided by the actuator 322 moves the gripper 320 towards and away from the upper pedestal 202 as indicated in phantom. Suitable rotary actuators include but are not limited to electric motors, air motors, pneumatic cylinders, hydraulic cylinders, cam actuators and the like. Although only one gripper assembly 218 is shown in the embodiment depicted in FIG. 2, it is contemplated that at least two or more gripper assemblies 218 may be utilized.

Figure 4:
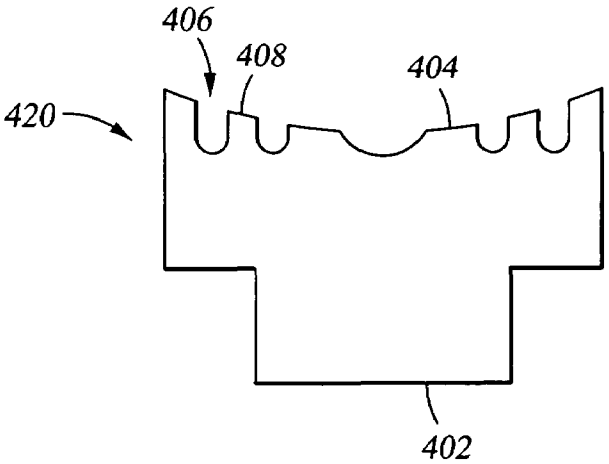
FIG. 4 is a plan view of one embodiment of a gripper of the gripper assembly.

The gripper 220 is typically configured to minimize contact with the back side of the substrate. For example, FIG. 4 depicts one embodiment of a gripper 420 that includes a back edge 402 for mounting to the bracket 224 (shown in FIG. 2) and a front edge 404 facing the substrate. The front edge 404 has a concavely curved surface formed at a predefined radius. The front edge 404 of the gripper 420 may additionally include one or more cut-outs 406 to define a plurality of contact fingers 408 along the front edge 404 of the gripper 420 to further reduce the surface area in contact between the gripper 420 and the substrate while maintaining a wide bearing surface. The wide bearing surface assists in reducing point loading and bending moments of the substrate during substrate exchanges wherein the gripper assembly 218 (shown in FIG. 2) engages the substrate. Moreover, the width of the gripper 420 is configured so at least two fingers 408 may engage a 200 millimeter substrate on both sides of a flat, detent, or other orientation feature formed in the substrate.

Referring simultaneously to FIGS. 2 and 2A, the upper pedestal 202 additionally may include one or more de-chucking nozzles 242 adapted to flow a fluid between the substrate and the polishing head 104 during de-chucking operations. For example, FIG. 2A depicts a de-chucking nozzle 242 flowing a stream of fluid 243 into the interface between the backside of a substrate 201 and the bladder 148 of the polishing head 104. The nozzles 242 are generally mounted to, or may be formed in, the lip 212 of the upper pedestal 202. The nozzles 242 are coupled to a fluid source 246 and are generally positioned facing radially inwards. In one embodiment, at least one drain 278 or other cut-out may be formed in the pedestal assembly 128 to facilitate drainage of fluids from the nozzles 242 or other sources. In the embodiment depicted in FIG. 2, the drain 278 is shown formed in the recessed area 208 of the upper pedestal 202. The recessed area 208 may also be curved or sloped to facilitate collection of fluid near the drain 278.

Figure 7:
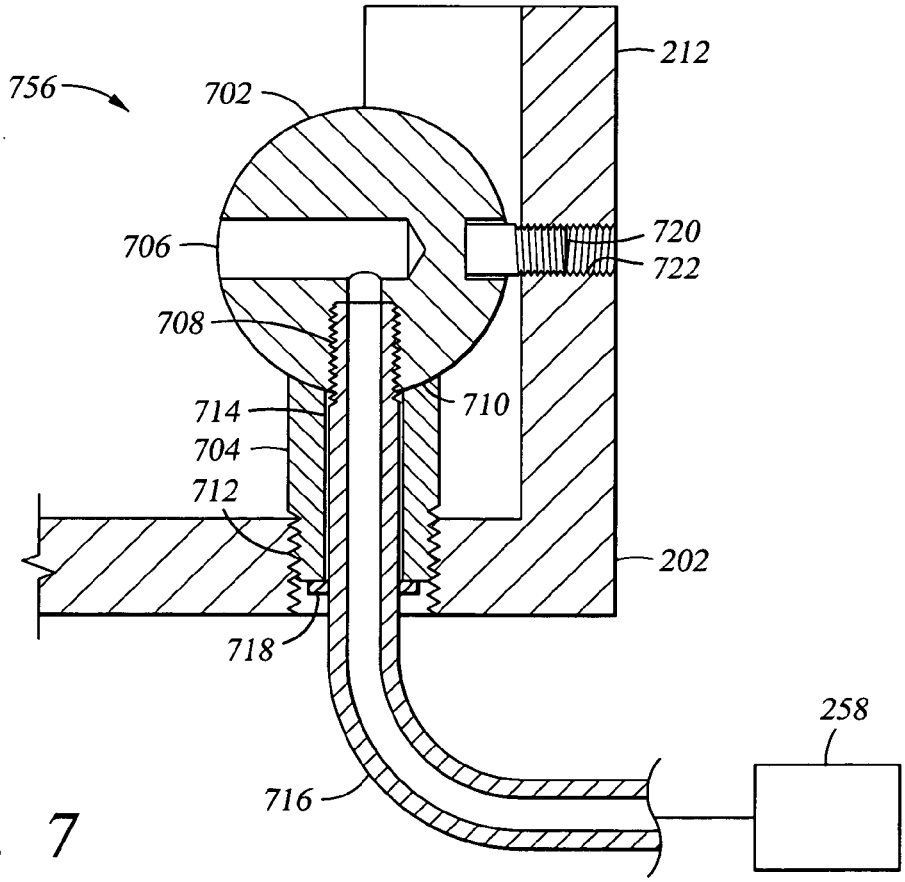
FIG. 7 is a sectional view of one embodiment of a de-chucking nozzle.

FIG. 7 depicts one embodiment of a de-chucking nozzle 756 adapted to produce a precisely aimed stream of fluid suitable for use in de-chucking the substrate from the polishing head 104 as described herein. De-chucking nozzle 756 includes a spherical nozzle head 702 and a support 704. The nozzle head 702 includes a nozzle 706 adapted to produce a flat, substantially horizontal stream of fluid. The flat stream maximizes the amount of fluid directed toward the interface between the bladder 148 of the polishing head 104 and the substrate. The support 704 includes a seat 710 for supporting the nozzle head 702 in the lip 212 of the upper pedestal 202. The nozzle head 702 rests in the seat and may be adjusted to direct the stream of fluid where desired. A set screw 720 disposed in a threaded hole 722 formed in the lip 212 of the upper pedestal 202 allows for securing the nozzle head 702 once positioned as desired.

The support 704 has a threaded lower portion 712 that mates with the upper pedestal 202 and allows for adjustment of the height of the nozzle 756. A hole 714 is formed through the center of the support 704 to allow a tube 716 to be secured to a threaded portion 708 of the nozzle head 702 and thereby fluidly couple the nozzle 706 to the fluid source 258. A collet 718 may be used to secure the tube 716 and nozzle head 702 to the support 704.

Referring back to FIG. 2, a plurality of substrate guides 248 are disposed on a main section 250 of the upper pedestal 202 radially between the lip 212 and the ledge 206. The substrate guides 248 are adapted to center the substrate in the load cup 110 during hand off from the transfer robot (not shown) to the upper pedestal 202 of the pedestal assembly 128. The substrate guides 248 may be configured to have a height that allows the load cup 110 to mate with the polishing head 104. Thus, when the pedestal assembly 128 is raised to meet the polishing head 104, the substrate guides 248 do not interfere with the mating of the polishing head 104 and the inner wall 214 of the lip 212. Alternatively, the guides 248 may retract during mating as described in the embodiment depicted in FIG. 6, described below.

In one embodiment, the substrate guides 248 are cylindrical members coupled to the main section 250 of the upper pedestal 202 in a spaced apart relation. The substrate guides 248 are positioned to allow an inward facing surface of the cylinder to operate as a guide for urging the substrate to rest in the ledge 206 of the upper pedestal 202. In the embodiment depicted in FIG. 2, the substrate guides 248 include a feature 252 adapted to facilitate entry of the substrate between the guides 248. The feature 252 is generally a surface flaring radially outward and upwards from the inner surface of the substrate guide 248. In the embodiment depicted in FIG. 2, the feature 252 is a chamfer on the upper end of the cylindrical substrate guide 248. Alternatively, the feature 252 of the substrate guide 248 may be a radial, elliptical, or other geometric form suitable for urging the substrate towards the central axis 200 of the load cup 110.

Figure 6:
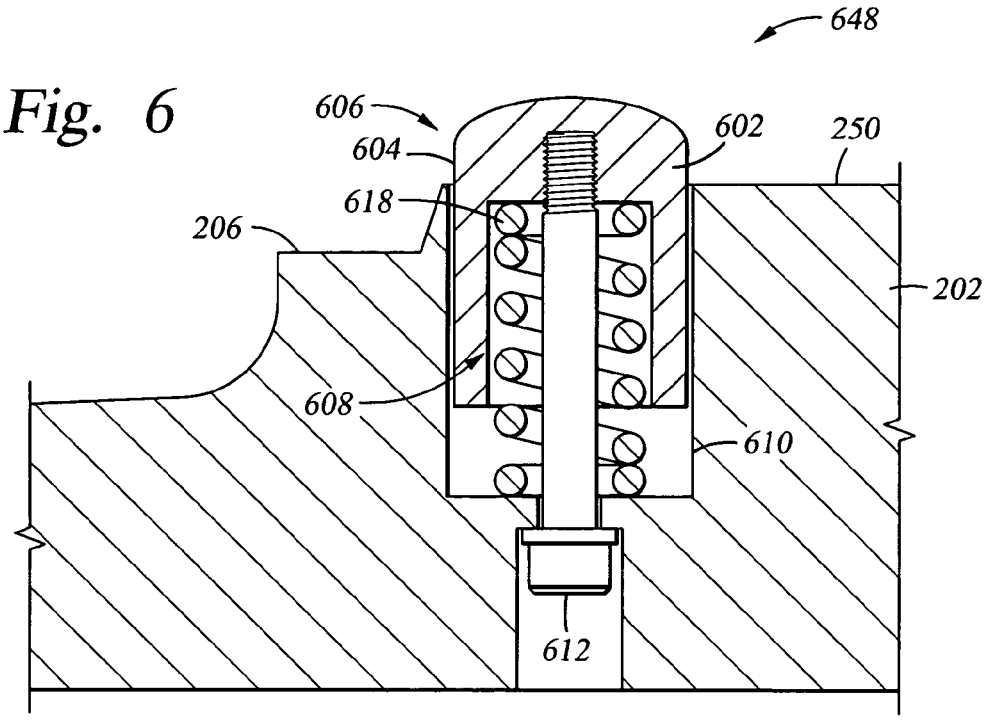
FIG. 6 is a sectional view of one embodiment of a substrate guide assembly.

FIG. 6 depicts one embodiment of a substrate guide 648 adapted to move between a position extended above the main section 250 of the upper pedestal 202 and a lower position flush with the main section 250 of the upper pedestal 202. In this embodiment, the guide 648 includes a cylindrical body 602 disposed in a hole 610 formed in the main section 250 of the upper pedestal 202 such that an inward facing surface 604 of the body 602 is proximate the ledge 206 of the upper pedestal 202. The body 602 has a relieved upper section 606 and a hollow lower section 608. The relieved upper section 606 may include a chamfer, radius, ellipse, or other geometric form suitable for urging a substrate being lowered onto the upper pedestal 202 towards the ledge 206. In the embodiment depicted in FIG. 6, the relieved upper section 606 has a convex, elliptical surface.

The substrate guide 648 is held in place by a screw 612, which extends through the upper pedestal 202 and into the body 602 of the substrate guide 648. A spring 618 is disposed in the hollow lower section 608 of the body 602 and extends to the bottom of the hole 610 in the upper pedestal 202. The spring 618 biases the substrate guide 648 to rest in an extended position above the main section 250 of the upper pedestal 202. The screw 612 may be used to adjust the extended height of the substrate guide 648. The body 602 of the substrate guide 648 is shorter in length than the depth of the hole 610 such that the substrate guide may be pressed flush with the main section 250 of the upper pedestal 202 by a force greater that the upward biasing force of the spring 618.

During de-chucking operations, the polishing head 104 and load cup 110 are positioned such that the substrate guide 648 remains in the extended position so that the relieved upper section 606 of the substrate guide 648 corrects any misalignment between the substrate being de-chucked and the ledge 206 of the upper pedestal 202. During a loading operation, the polishing head 104 and load cup 110 are positioned such that the substrate guide 648 is flush with the main section 250 of the upper pedestal 202 so that the travel distance of the substrate being transferred from the load cup 110 to the polishing head 104 is minimized.

Referring back to FIG. 2, in one embodiment, the lower pedestal 204 may include a plurality of rinsing nozzles 256 adapted to flow a jet of cleaning solution toward the polishing head 104. The rinsing nozzles 256 may be used to clean the feature side of the substrate prior to de-chucking and/or to clean the polishing head 104 after the substrate has been removed from the polishing head 104 and off-loaded from the load cup 110. In the embodiment depicted in FIG. 2, the rinsing nozzles 256 are coupled to the lower pedestal 204 of the pedestal assembly 128 and are disposed beneath a slot 260 formed in the upper pedestal 202. Alternatively, the rinsing nozzles 256 may be coupled to or formed in the upper pedestal 202.

Generally, the rinsing nozzles 256 are positioned such that the cleaning solution flowing therefrom will contact the entire lower surface of the polishing head 104, or a substrate retained therein, when the polishing head 104 is rotated. In the embodiment depicted in FIG. 2, the rinsing nozzles 256 are arranged in a group of radially aligned nozzles.

The rinsing nozzles 256 are coupled to a cleaning fluid source 258. The cleaning fluid source 258 generally includes a pressurization apparatus such as a pump and a cleaning solution reservoir (not shown) to facilitate flowing the cleaning solution out of the rinsing nozzles 256 with sufficient force to clean the polishing head 104 when a substrate is not present. The rinsing nozzles 256 can also be used to clean the exposed surface of a substrate retained in the polishing head 104. The cleaning solution may be selected to have a pH similar to the pH of the polishing solution, or may be de-ionized water, among other fluids.

In one embodiment, the pedestal assembly 128 additionally includes at least one sensor 263 adapted to detect the presence of the substrate in the load cup 110. The substrate sensor 263 may be disposed on the upper pedestal 202 or may alternatively be mounted to the lower pedestal 204. Each sensor 263 may include a fish-eye lens 262 that increases the sensing field. Suitable sensors 263 include proximity sensors and optical sensors among other non-contact sensing devices suitable for detecting the presence of the substrate.

In the embodiment depicted in FIG. 2, the sensor 263 is mounted on the lower pedestal 204 at an upward angle 290 in order to sense the presence of a substrate through a slot 264 formed in the upper pedestal 202. The sensor 263 may be mounted such that fluid flowing from the nozzles 242 may be utilized to clean the sensor 263 when a substrate is not present. For example, the sensor 263 may be mounted such that the angle 290 is less than 90 degrees with respect to horizontal and such that the sensor 263 is aligned with the de-chucking nozzles 242. The substrate sensors are generally coupled to a controller (not shown) which controls the operation of the system.

The cup 130 is disposed about the pedestal assembly 128. The cup 130 is supported by a shaft 138. The shaft 138 is coupled to an actuator 132 that positions the cup 130 in an extended and a retracted position relative to the base 126. The cup 130 may also include a collar 270 coupled to the bottom of the cup 130 and circumscribing the shaft 138. The collar 270 is configured to interleave with a collar 272 disposed on the base 126 to form a weir 274. The weir 274 prevents excess fluids from flowing down the hole 134 in the base 126. A drain 276 may be provided to collect and divert excess fluids from the processing area (shown in phantom).

In one embodiment, the load cup 110 may also include a head cleaning tower 280 disposed outward of the pedestal assembly 128. The head cleaning tower 280 includes a plurality of nozzles 282 oriented to rinse the exterior of the polishing head 104 when the polishing head is engaged with the load cup 110. The nozzles 282 disposed in the head cleaning tower 280 are generally angled radially inwards and downwards to facilitate cleaning of the polishing head 104. In the embodiment depicted in FIG. 2, the head cleaning tower 280 is mounted on a bracket 286 coupled to the cup 130. The nozzles 282 are coupled to a head rinse fluid source 284 which provides cleaning fluid such as de-ionized water or other fluid suitable for use in a load cup (i.e., a fluid that does not pose a risk of cross contamination during polishing or other substrate processing).

Figure 8:
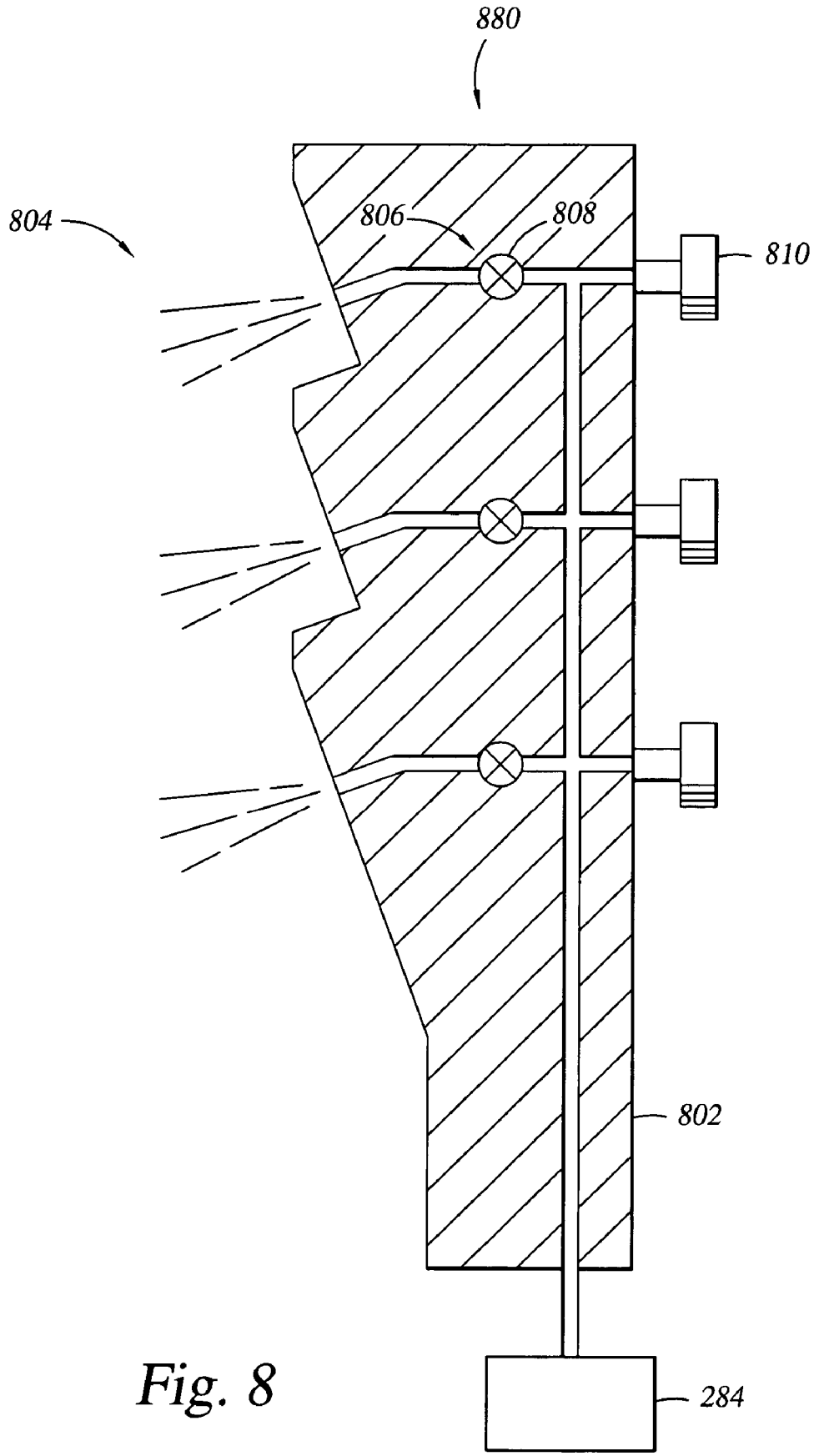
FIG. 8 is a schematic side view of one embodiment of a head cleaning tower.

FIG. 8 depicts one embodiment of a head cleaning tower 880 suitable for use with a load cup as described herein. The head cleaning tower 880 includes a body 802 coupled to the fluid source 284. The body 802 includes a plurality of nozzles 804 formed therein and adapted to produce a stream of fluid when fluid from the fluid source 284 is supplied. One or more of the nozzles 804 may include a flow control mechanism 806 to selectively increase, decrease, or shut off the fluid flowing from the fluid source 284 to the nozzles 804. The flow control mechanism 806 is generally a valve 808 having an adjuster 810 adapted to incrementally open and close the valve 808. Thus, a user may selectively choose which portions of the load cup 110 or polishing head 104 to clean and with what fluid force by opening, closing, or adjusting selected nozzles 804.

Figure 5A:
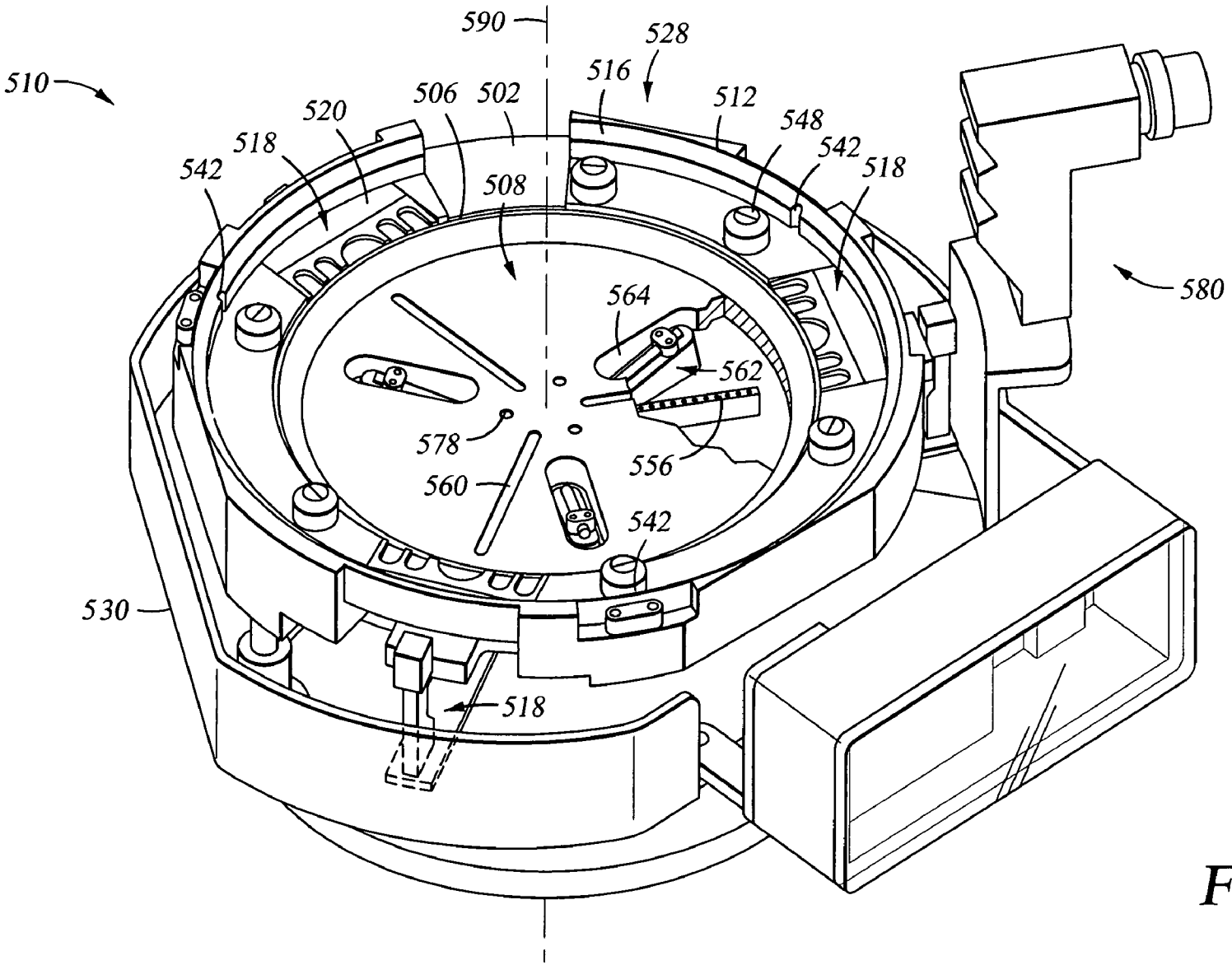
FIG. 5A is an isometric, partial cut-away view of another embodiment of a load cup.
Figure 5B:
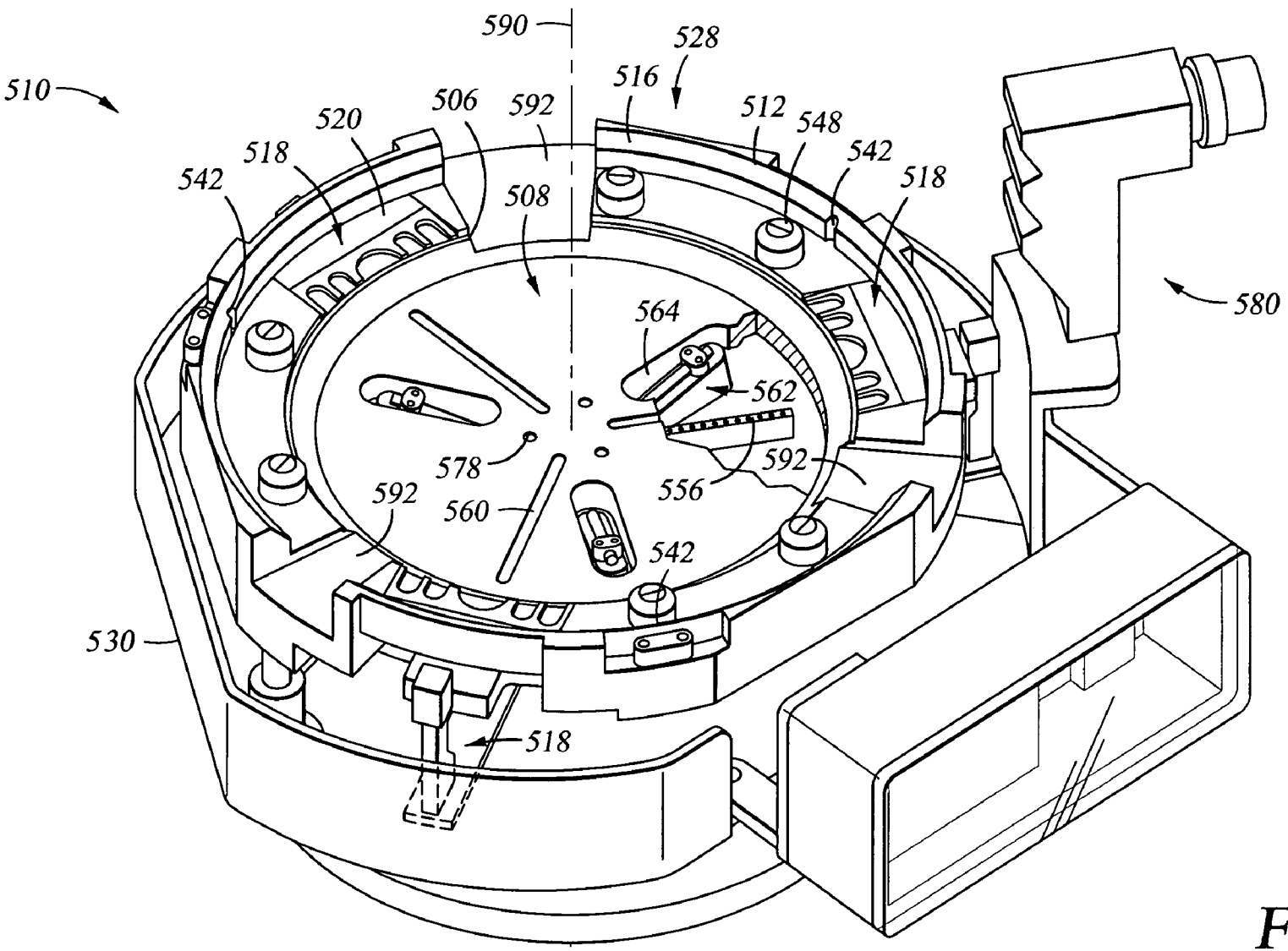
FIG. 5B is an isometric, partial cut-away view of another embodiment of a load cup.

FIG. 5A is an isometric, partial cut-away top view of another embodiment of a load cup 510. The load cup 510 includes a pedestal assembly 528 circumscribed by a cup 530. The pedestal assembly 528 includes an annular lip 512 with a chamfered inner wall 516 to facilitate alignment with the polishing head 104 (shown in FIG. 1) during substrate loading and unloading. A notch 502 is formed in the lip 512 to facilitate access to the substrate by a blade of a substrate transfer robot (not shown). Alternatively, as shown in FIG. 5B, a plurality of larger notches 592 may be formed through the upper pedestal to accommodate robots equipped with edge-grip substrate transfer blades.

Returning to FIG. 5A, a narrow ledge 506 surrounds a recessed area 508 in the pedestal assembly 528 to facilitate contact with the substrate only in the exclusion zone. Six cylindrical substrate guides 548 are distributed about the pedestal assembly 528 proximate the ledge 506 to assist in aligning the substrate with the ledge 506. The pedestal assembly 528 is configured to pivot relative to the central axis 590 as well as to move laterally relative to a nominal center position in order to provide a substrate capture range of about three millimeters from the nominal center position (as described above with respect to FIG. 2).

Three gripper assemblies 518 are coupled to the pedestal assembly 528 in a substantially equidistantly spaced-apart relation about the perimeter of the pedestal assembly 528 to facilitate de-chucking a substrate from the polishing head 104. The gripper assemblies 518 are radially aligned to the central axis 590 of the load cup 510 and are partially disposed through the lip 512 of the pedestal assembly 528 such that a gripper 520 of each gripper assembly 518 extends over the ledge 506 when in a retracted position.

To further assist in de-chucking the substrate, three de-chucking nozzles 542 are formed in the lip 512 of the pedestal assembly 528. The de-chucking nozzles 542 are in alignment with three substrate sensors 562 mounted to the bottom of the pedestal assembly 528 and protruding through slots 564 formed in the recessed area 508 of the pedestal assembly 528. The substrate sensors 562 are adapted to detect the presence of a substrate in the load cup 510. The de-chucking nozzles 542 are configured to be able to clean the substrate sensors 562 when a substrate is not present.

Three groups of rinsing nozzles 556 are mounted on the bottom of the pedestal assembly 528 (one shown in cut-away) extending radially from the central axis 590. A slot 560 is formed in the bottom of the recessed area 508 over each group of nozzles 556 to allow rinsing fluid to be sprayed upwards. Three drains 578 are formed near the central axis 590 to facilitate removal of fluid from the pedestal assembly 528. A head cleaning tower 580 is mounted to the cup 530 in radial alignment with a central axis 590 of the load cup 510.

One mode of operation of the polishing head 104 and load cup 110 is described below, generally with respect to FIGS. 1 and 2, but applicable to all embodiments of the load cup described herein. Initially, the pedestal assembly 128 of the load cup 110 is extended by the actuator 133 to receive a substrate supported thereover by a substrate transfer robot (not shown). The pedestal assembly 128 may lift the substrate directly from the blade, or alternatively, the pedestal assembly 128 may be elevated, and the blade of the robot lowered to exchange the substrate from the blade to the load cup 110. As the pedestal assembly 128 nears the substrate, the substrate guides 248 correct any substantial misalignment between the substrate and the pedestal assembly 128, as described with respect to FIG. 2, above.

After the transfer robot is withdrawn, the polishing head 104 is disposed above the load cup 110 and lowered into position. The pedestal assembly 128 and cup 130 of the load cup 110 are respectively elevated by actuators 133, 132 to engage the polishing head 104 with the load cup 110. The retaining ring 150 of the polishing head 104 mates with the feature 216 formed on the interior wall of the lip 212 of the pedestal assembly 128 to ensure alignment therebetween. The upper pedestal 202 of the pedestal assembly 128 may move angularly and laterally with respect to the central axis 200 of the load cup 110 in order to compensate for any potential misalignment between the load cup 110 and the polishing head 104.

The bladder 148 of the polishing head 104 is then deflated to create a vacuum between the back side of the substrate and the bladder 148, thereby retaining the substrate to the polishing head 104. Optionally, the de-chucking nozzles 242 may provide a liquid such as de-ionized water on the back side of the substrate prior to contacting the bladder 148 to enhance sealing of the bladder 148 to the substrate, thereby improving the vacuum retention of the substrate to the polishing head 104.

Next, the cup 130 and pedestal assembly 128 are lowered away from the polishing head 104 and the polishing head 104 is elevated to disengage from the load cup 110. The substrate is then transferred to the polishing station 102 where the substrate is pressed against the polishing material 116. Relative motion is provided between the substrate retained in the polishing head 104 and the polishing material 116 in the presence of polishing fluid to process the substrate.

After processing, the substrate is returned to a position over the load cup 110 and the polishing head 104 is lowered and the pedestal assembly 128 is raised to engage the polishing head 104 with the pedestal assembly 128. Head cleaning fluid is sprayed on the outer surface of the polishing head 104 by the head cleaning tower 280 while the polishing head 104 is rotated to remove any contaminants from the exterior portion of the polishing head 104. The bladder 148 is then inflated to transfer the substrate to the pedestal assembly 128 of the load cup 110. As the bladder 148 inflates, the edges of the substrate separate from the bladder 148 prior to the center portion of the substrate. To enhance the de-chucking of the substrate, the de-chucking nozzles 242 spray a fluid between the edge of the substrate which has separated from the bladder 148 and the center portion of the substrate which is still in contact with the bladder 148 (shown in FIG. 2A). The force of the jet releases any stiction between the bladder 148 and the back side of the substrate, and vents any residual pockets of vacuum remaining between the substrate and bladder 148.

In addition, the gripper assemblies 218 are actuated to position the grippers 220 between the back side of the substrate and the polishing head 104 (shown in FIG. 2B). It is contemplated that the grippers 220 may be utilized in conjunction with or in place of the de-chucking nozzles 242. Alternatively, the de-chucking nozzles 242 may be utilized without the gripper assemblies 218. Additionally, it is contemplated that the sequence of using the de-chucking nozzles 242 and gripper assemblies 218 may occur in either order or simultaneously.

Next, the pedestal assembly 128 is lowered and the polishing head 104 is raised to disengage from the load cup 110. The pedestal assembly 128 is again raised to allow the processed substrate to be retrieved by the robot. Once the load cup 110 and polishing head 104 are free of the substrates, the rinsing nozzles 256 are activated to clean any contaminants from the underside of the polishing head 104 and to moisten the bladder 148, which facilitates improved vacuum retention of subsequently processed substrates.

Thus, a load cup has been provided that at least advantageously insures reliable de-chucking from the polishing head. Moreover, the load cup is configured to enhance cleanliness of the polishing head thereby reducing the probability of contamination and damage to the substrates. Although the load cup disclosed herein is described with respect to various embodiments, it is contemplated that the features disclosed in any particular embodiment of the load cup may be used in combination with features described in any of the other embodiments.

While the foregoing is directed to the preferred embodiment of the present invention, other and further embodiments of the invention may be devised without departing from the basic scope thereof, as determined by the claims that follow.

The invention claimed is:

1. A load cup for transferring a substrate in a processing system, comprising:

a pedestal assembly having a substrate support; and a de-chucking nozzle positioned to flow a fluid between a polishing head and a back side of a substrate during transfer of the substrate from the polishing head to the substrate support.

2. The load cup of claim 1, wherein the de-chucking nozzle is disposed in the pedestal assembly.

3. The load cup of claim 1, wherein the pedestal assembly further comprises:

a main section having a recessed outer diameter surface; and a lip extending upwards from the outer diameter surface.

4. The load cup of claim 3, wherein the de-chucking nozzle is disposed in the lip.

5. The load cup of claim 1, further comprising:

a sensor adapted to detect the presence of a substrate on the substrate support.

6. The load cup of claim 5, wherein the de-chucking nozzle is radially aligned with the sensor.

7. The load cup of claim 6, wherein the sensor has a sensing portion oriented towards the de-chucking nozzle.

8. The load cup of claim 1, further comprising:

a plurality of de-chucking nozzles disposed about a perimeter of the pedestal assembly and facing radially inwards; and a plurality of sensors adapted to detect the presence of a substrate on the substrate support, the sensors having a sensing portion aligned with and oriented towards the de-chucking nozzles.

9. The load cup of claim 1, further comprising:

a gripper assembly adapted to engage the back side of the substrate to retain the substrate in the load cup.

10. The load cup of claim 9, wherein the gripper assembly further comprises:

a gripper; and an actuator adapted to move the gripper in a direction towards and away from a center of the pedestal assembly.

11. The apparatus of claim 10, wherein the gripper further comprises:

a plurality of gripper fingers.

12. The load cup of claim 10, wherein the gripper assembly further comprises:

a concave inner edge formed on an edge of the gripper facing the center of the pedestal assembly.

13. The load cup of claim 1, further comprising:

a plurality of gripper assemblies coupled to and spaced around an outer perimeter of the pedestal assembly, the gripper assemblies adapted to selectively engage a back side of the substrate.

14. The load cup of claim 1, further comprising:

a plurality of substrate guides adapted to align the substrate on the substrate support.

15. The load cup of claim 14, wherein the substrate guides have a radiused upper surface.

16. A load cup for transferring a substrate, comprising:

a pedestal assembly having a substrate support and a lip extending upwards from an outer diameter of the pedestal assembly;

a plurality of de-chucking nozzles formed in the lip and positioned to flow a fluid between a polishing head and a back side of a substrate during transfer of the substrate from the polishing head to the substrate support;

a plurality of sensors coupled to the pedestal assembly and adapted to detect the presence of a substrate on the substrate support, the sensors having a sensing portion aligned with and oriented towards the de-chucking nozzles;

a plurality of gripper assemblies coupled to the pedestal assembly and adapted to selectively engage the back side of the substrate to retain the substrate in the load cup; and a plurality of substrate guides adapted to align the substrate with the substrate support.

17. A polishing system, comprising:

a polishing head;

a polishing station;

a load cup; and a de-chucking mechanism coupled to the load cup and adapted for engaging a back side of a face down substrate during de-chucking of the substrate disposed between the polishing head and load cup.

18. The polishing system of claim 17, wherein the de-chucking mechanism further comprises a nozzle positioned to flow a fluid between the polishing head and the back side of the substrate during transfer of the substrate from the polishing head to the substrate support.

19. The polishing system of claim 17, wherein the de-chucking mechanism further comprises a plurality of gripper assemblies coupled to the pedestal assembly and adapted to selectively engage the back side of the substrate to retain the substrate in the load cup.

20. A method of transferring a substrate between a polishing head and a load cup in a chemical mechanical polishing system, the method comprising:

engaging a polishing head having a face down substrate disposed therein with a load cup;

activating the load cup to engage the back side of the substrate; and transferring the substrate face down into the load cup.

21. The method of claim 20, wherein the step of activating further comprises:

flowing a fluid from a nozzle between the back side of the substrate and the polishing head.

22. The method of claim 21, further comprising:

cleaning a substrate sensor disposed in the load cup by flowing a fluid from the nozzle to contact the sensor.

23. The method of claim 20, wherein the step of activating further comprises:

moving a gripper between the back side of the substrate and the polishing head.

24. The method of claim 23, wherein the step of activating further comprises:

flowing a fluid between the back side of the substrate and the polishing head.

25. The method of claim 23, further comprising:

cleaning a substrate sensor disposed in the load cup by flowing a fluid from the nozzle to contact the sensor.

26. The method of claim 20, wherein the step of activating further comprises:

applying a de-chucking force from the load cup to the back side of the substrate.

* * * * *